US005330077A

United States Patent [19]

Swanson

[11] Patent Number: 5,330,077

[45] Date of Patent: Jul. 19, 1994

[54] ACCUMULATOR FOR SQUEEZING PLIANT TUBES

[76] Inventor: Kathryn Swanson, 421 E. Hoffman, Cannon Falls, Minn. 55009

[21] Appl. No.: 68,660

[22] Filed: May 27, 1993

[51] Int. Cl.[5] ..... B65D 35/28

[52] U.S. Cl. ..... 222/95; 222/103; 222/105

[58] Field of Search ..... 222/92, 95, 103, 107, 222/181, 180, 105

[56] References Cited

U.S. PATENT DOCUMENTS

| | | | |
|---|---|---|---|
| D. 261,453 | 10/1981 | Pool . | |
| D. 267,993 | 2/1983 | Barrera . | |
| D. 282,268 | 1/1986 | Coyne . | |
| D. 292,071 | 9/1987 | Weir . | |
| D. 313,136 | 12/1990 | Everett et al. . | |
| D. 313,914 | 1/1991 | Tribbey . | |
| D. 315,842 | 4/1991 | Tallman . | |
| D. 325,688 | 4/1992 | Schrieb . | |
| 1,655,410 | 1/1928 | Bullock | 222/181 X |
| 2,037,989 | 4/1936 | Macklanburg | 222/95 X |
| 2,083,603 | 6/1937 | Harwick | 222/95 |
| 2,340,681 | 2/1944 | Oursler | 222/103 X |
| 2,554,975 | 5/1951 | Bendick | 222/95 |
| 4,010,871 | 3/1977 | Broadie . | |
| 4,010,873 | 3/1977 | Madirossian . | |
| 4,159,787 | 7/1979 | Wright . | |
| 4,160,513 | 7/1979 | Cockerham . | |
| 4,574,983 | 3/1986 | Fatkin . | |
| 4,949,875 | 8/1990 | Kuo . | |
| 4,976,380 | 12/1990 | von Schuckmann | 222/103 |
| 4,991,744 | 2/1991 | Von Schuckmann . | |
| 5,035,347 | 7/1991 | Trovo . | |
| 5,048,725 | 9/1991 | Peterson . | |
| 5,050,773 | 9/1991 | Choi . | |
| 5,082,144 | 1/1992 | Sundstrom . | |
| 5,097,987 | 3/1992 | Liberatore . | |
| 5,104,009 | 4/1992 | Battegazzore . | |
| 5,115,948 | 5/1992 | Johnson . | |
| 5,131,567 | 7/1992 | Lipsey . | |
| 5,145,093 | 9/1992 | Zeller . | |
| 5,145,095 | 9/1992 | Loudon . | |
| 5,167,348 | 12/1992 | Okami et al. . | |
| 5,178,301 | 1/1993 | McGanty . | |
| 5,178,302 | 1/1993 | Cheng . | |

*Primary Examiner*—Gregory L. Huson
*Attorney, Agent, or Firm*—Faegre & Benson

[57] ABSTRACT

An appliance for accumulating a viscid material from a pliant tube including a structural frame which defines a wedge-shaped channel having a major longitudinal open end and a minor longitudinal open end. The appliance may include a transversely pliant, longitudinally arcuate flap positioned laterally along the forward edge of the frame at the minor end of the channel for selectively compressing a tube operably retained with the appliance between the flap and a rear panel by pressing the flap towards the rear panel. The appliance is particularly well adapted for dispensing toothpaste from a standard toothpaste tube.

14 Claims, 2 Drawing Sheets

ACCUMULATOR FOR SQUEEZING PLIANT TUBES

SUMMARY OF THE INVENTION

The invention relates to appliances for accumulating viscid materials retained within pliant tubes. More specifically, the invention relates to appliances for storing and accumulating toothpaste retained within a standard toothpaste tube.

BACKGROUND OF THE INVENTION

Many different devices have been developed for squeezing viscid materials from a pliant tube. These devices range from simple devices such as the one-piece clamp disclosed in U.S. Pat. No. 4,159,787 to complex devices such as the electrical dispenser disclosed in U.S. Pat. No. 5,050,773. The simple devices, while inexpensive, are generally difficult to operate and/or ineffective for completely squeezing the viscid material from the tube. In contrast, the complex devices, while generally easy to use and effective for squeezing substantially all the viscid material from a pliant tube, are relatively expensive and subject to malfunction.

Accordingly, a need exists for a simple, inexpensive device which is easy to operate and effective for completely squeezing the viscid material from a pliant tube.

SUMMARY OF THE INVENTION

I have invented an appliance for accumulating a viscid material from a pliant tube. The appliance is a structural frame which defines a wedge-shaped channel with a depth of about 3 to 10 cm at the major longitudinal open end and a depth of about 0.5 to 2 cm at the minor longitudinal open end. The appliance is particularly well adapted for dispensing toothpaste from a standard toothpaste tube.

The appliance is preferably molded as a single piece from an elastomeric material with the frame including (i) a rear panel longitudinally extending about 1 to 20 cm beyond the minor longitudinal end of the channel for preventing potentially damaging contact between a tube being operably manipulated within the appliance and a supporting surface underneath the rear panel, and (ii) a front panel transversely spaced from the rear panel which is longitudinally angled from the rear panel at an angle of about 5° to 40° to form the wedge-shaped channel.

The appliance may further include a transversely pliant, longitudinally arcuate flap positioned laterally along substantially the entire lateral length of the forward edge of the frame at the minor end of the channel for compressing a tube operably retained with the appliance between the flap and the rear panel when the flap is pressed towards the rear panel.

The appliance may still further include a means for mounting the frame to a support surface such as dual-side adhesive tape, screws, a mounting bracket, etc.

BRIEF DESCRIPTION OF THE DRAWINGS

FIG. 3 is a top view of the appliance depicted in FIG. 1 excluding the toothpaste tube.

DETAILED DESCRIPTION OF THE INVENTION INCLUDING A BEST MODE

I have invented an appliance 10 for accumulating a viscid material from a pliant tube 100. The appliance 10 may be sized to accommodate substantially any sized tube 100 from trial size toothpaste tubes to commercial sized tubes of grease. The appliance 10 is also effective for accumulating substantially any viscid material from toiletries such as hand lotion and petroleum jelly to industrial supplies such as silicon adhesive and caulk.

The appliance 10 is particularly well adapted for dispensing toothpaste from a standard nonelastic toothpaste tube 100. Accordingly, for purposes of clarifying further description of the appliance 10 but without intending to be unduly limited thereby, the remainder of this description will focus upon an appliance 10 designed for use with a standard household toothpaste tube 100.

Nomenclature

10 Appliance
11 Longitudinal Axis of Appliance
12 Lateral Axis of Appliance
13 Transverse Axis of Appliance
13$d^1$ Transverse Depth of the Channel at the Minor Open End
15 Front of Appliance
16 Back of Appliance
17*r* Right Side of Appliance
17*s* Left Side of Appliance
18 Top of Appliance
19 Bottom of Appliance
20 Frame
25 Front Panel
26 Rear Panel
27*r* Right Side Panel
27*s* Left Side Panel
30 Channel
31 Longitudinal Length of Channel
32 Lateral Width of Channel
33 Transverse Depth of Channel
38 Major Open End of Channel
39 Minor Open End of Channel
40 Flap
40$d^1$ Transverse Distance From Flap to Rear Panel w/Flap in Rest Position
40$d^2$ Transverse Distance From Flap to Rear Panel w/Flap in Interactive Position
50 Adhesive Pad
60 Release Liner
100 Tube
101 Closed End of Tube
102 Open End of Tube

Description

Construction

Figure 1:
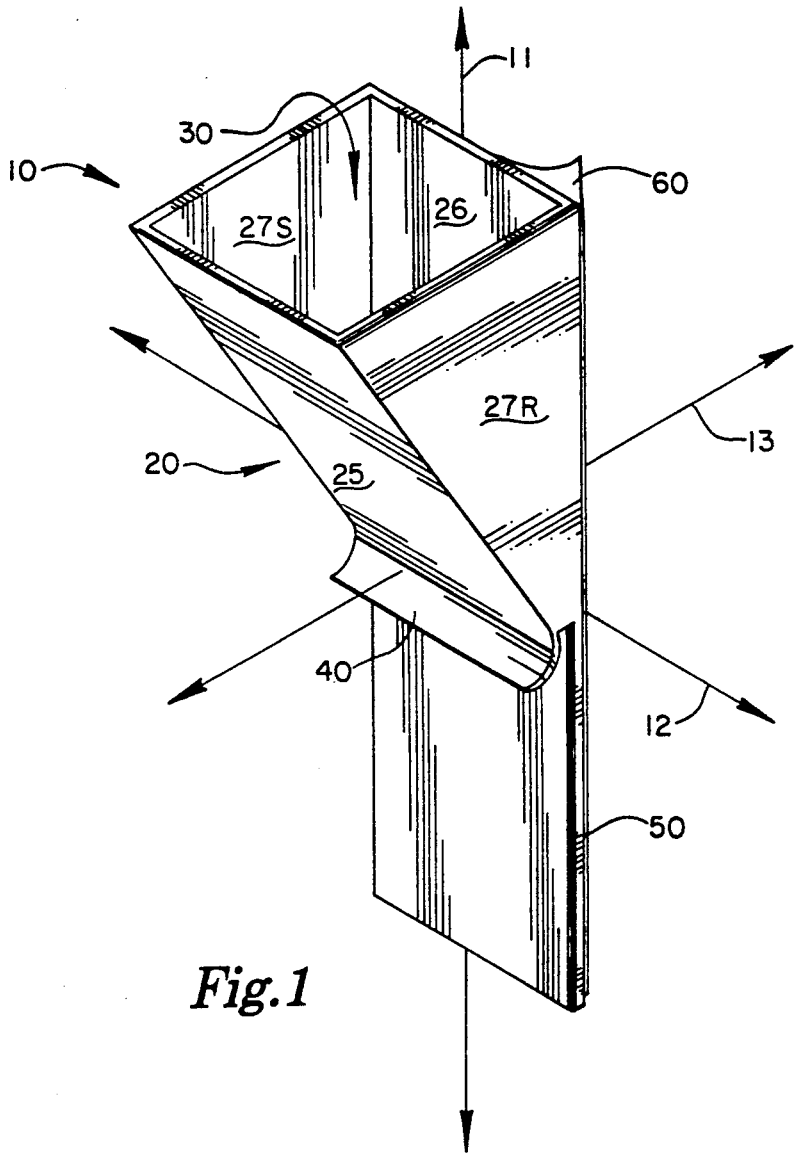
FIG. 1 is a perspective view of one embodiment of the appliance.
Figure 2:
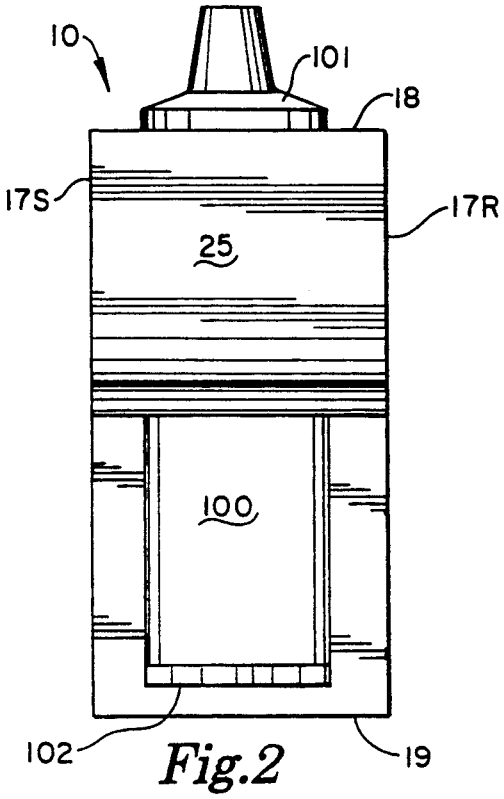
FIG. 2 is a front view of the appliance depicted in FIG. 1 including depiction of a toothpaste tube operably retained within the appliance.

For purposes of facilitating structural configuration of the appliance 10 the longitudinal axis 11, lateral axis 12, and transverse axis 13 of the appliance 10 are depicted in FIG. 1. The longitudinal axis 11 extends between the top 18 and the bottom 19 of the appliance 10 and defines length. The lateral axis 12 extends between the right side 17r and left side 17s of the appliance 10 and defines width. The transverse axis 13 extends from the front 15 of the appliance 10 to the back 16 of the appliance 10 and defines depth.

The appliance 10 includes a frame 20 having a rectangular front panel 25, a rectangular rear panel 26, and triangular mirror-image right and left side panels 27r and 27s.

The frame 20 defines a wedge-shaped channel 30. The channel 30 has a major open end 38 proximate the top 18 of the appliance 10 and a minor open end 39 proximate the bottom 19 of the appliance 10. While the channel 30 may be sized to accommodate substantially any sized tube 100, an appliance 10 intended for use in connection with a standard household toothpaste tube 100 should have a channel 30 with (i) a longitudinal length 31 of about 5 to 20 cm, preferably about 7 to 10 cm; (ii) a lateral width 32 of about 7 to 20 cm, preferably about 7 to 10 cm; and (iii) a transverse depth 33 which ranges from about 3 to 10 cm, preferably about 4 to 7 cm, at the major longitudinal open end 38 and a transverse depth 33 of about 0.5 to 2 cm, preferably about 0.5 to 1 cm, at the minor longitudinal open end 39. The longitudinal length 31 has been established so that the appliance 10 is aesthetically pleasing and suitable for both storage of a tube 100 and gradual squeezing of toothpaste from the closed end 101 to the open end 102 of the tube 100. The lateral width 32 has been established so that the appliance 10 is aesthetically pleasing, and capable of supporting a standard household toothpaste tube 100 in a lateral upright position while accommodating longitudinal passage of the tube 100 through the channel 30 when flattened. The transverse depth 33 at the major longitudinal open end 38 has been established so that the channel 30 is capable of supporting an unused standard household toothpaste tube 100 in a transverse upright position while permitting easy introduction of the tube 100 into the channel 30. The transverse depth 33 at the minor longitudinal open end 39 has been established so that substantially all toothpaste retained within a toothpaste tube 100 which has been fed completely through the channel 30 will have been squeezed towards the open end 102 of the tube 100 while permitting easy passage of a transversely flattened tube 100 out through the minor longitudinal open end 39 of the channel 30. In addition, the dimensions should be selected relative to one another to provide an aesthetically pleasing appliance 10.

The triangular side panels 27r and 27s produce the wedge-shaped configuration of the channel 30 by longitudinally angling the front panel 25 relative to the rear panel 26 at an angle of about 10° to 30°. The angle should be within this range so that the relationship between the longitudinal length and the transverse depth 33 of the channel 30 is aesthetically pleasing and suitable for both storage of a tube 100 and gradual squeezing of toothpaste from the closed end 101 to the open end 102 of the tube 100.

The appliance 10 includes a transversely pliant, longitudinally arcuate flap 40 positioned laterally along substantially the entire lateral length of the bottom edge (unnumbered) of the front panel 25 at the minor longitudinal open end 39 of the channel 30. The flap 40 is effective for compressing a tube 100 operably retained with the appliance 10 between the flap 40 and the rear panel 26 when the flap 40 is pressed towards the rear panel 26.

Figure 3:
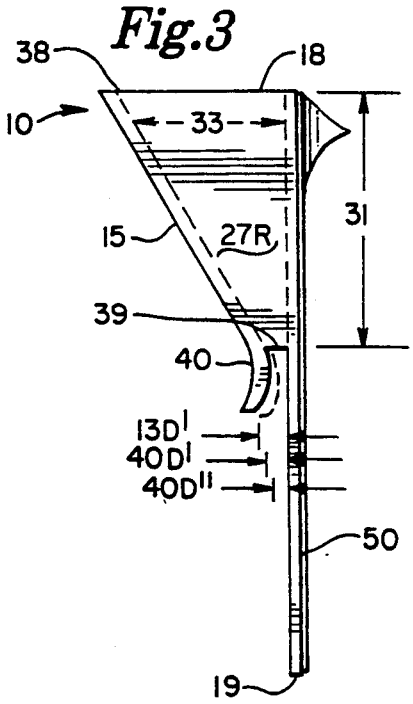
FIG. 3 is a side view of the appliance depicted in FIG. 1 excluding the toothpaste tube.
Figure 4:
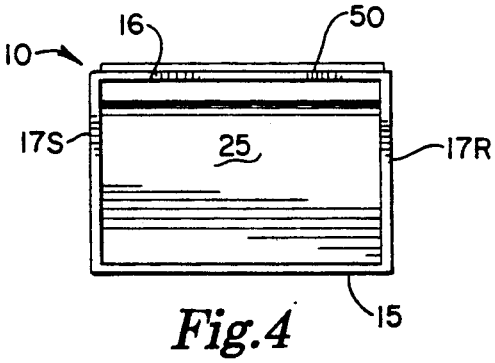
FIG. 4 is a bottom view of the appliance depicted in FIG. 1 excluding the toothpaste tube.
Figure 5:
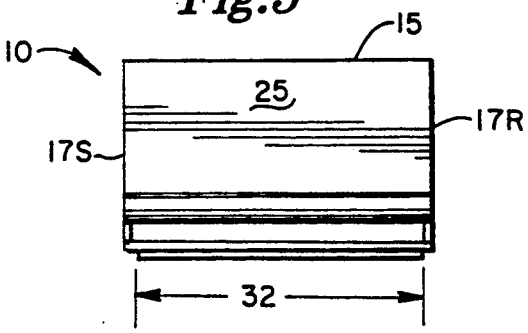

Referring to FIG. 3, the flap 40 is transversely flexible from a rest position, shown in the Figure, to an interactive position, shown in phantom. When in the normal, biased, rest position, the flap 40 is transversely spaced from the rear panel 26 by a distance $40d^1$ which is greater than the transverse depth $13d^1$ of the channel 30 at the minor longitudinal open end 39 so that the flap 40 does not interact with a tube 100 extending through the minor longitudinal open end 39 of the channel 30. However, when pressed towards the rear panel 26 and into the interactive position, the flap 40 is transversely spaced from the rear panel 26 by a distance $40d^2$ which is less than the transverse depth $13d^1$ of the channel 30 at the minor longitudinal open end 39 so that the flap 40 squeezes a tube 100 extending through the minor longitudinal open end 39 of the channel 30. The flap 40 is useful for achieving complete accumulation of all toothpaste in a tube 100 at the open end 102 of the tube 100.

The appliance 10 may be mounted to a vertical or horizontal support surface (not shown), such as a bathroom wall, medicine chest door, or vanity top. The appliance 10 may be mounted by any convenient means including an adhesive, a mounting bracket, hook and loop tape (VELCRO), nails, screws, etc. Referring to FIG. 3, a commercially available, dual-sided, foamed adhesive pad 50 is attached to the back surface (unnumbered) of the rear panel 26 for mounting the appliance 10 to a support surface (not shown). As is customary, a release liner 60 is provided to prevent premature adhesion.

Operation

A toothpaste tube 100 may be stored in the appliance 10 and toothpaste simultaneously accumulated towards the open end 103 of the tube 100 by simply inserting the closed end 101 of the tube 100 into the channel 30 through the major longitudinal open end 38 until the tube 100 becomes firmly wedged into the appliance 10.

Once sufficient toothpaste has been used from the tube 100 so that the closed end 101 of the tube 100 extends beyond the minor longitudinal open end 39 of the channel 30 the flap 40 may be used as desired to complete movement of toothpaste within the tube 100 from the closed end 101 to the open end 102 of the tube 100. The flap 40 is used by simply pressing the flap 40 towards the rear panel 26 using the pointer and middle fingers until the sides of the tube 100 are fully compressed and then longitudinally moving the tube 100 by either pushing the tube 100 into the channel 30 from the open end 102 or pulling the tube 100 from the channel 30 by the closed end 101 until the desired accumulation is achieved.

I claim:

1. An appliance for accumulating a viscid material from a pliant tube comprising a unitary fully stationary frame which defines a wedge-shaped channel having a depth of about 3 to 10 cm at the major longitudinal open end and a depth of about 0.5 to 2 cm at the minor longitudinal open end, wherein the frame includes a front portion and a rear portion, with the front portion transversely spaced and longitudinally angled from the rear portion to form the wedge-shaped channel, and the frame is adapted for receiving a pliant tube placed into the channel through the major longitudinal open end and moved through the minor longitudinal open end.

2. The appliance of claim 1 wherein the frame is a single piece.

3. The appliance of claim 1 wherein the frame includes front and rear panels with the front panel transversely spaced and longitudinally angled from the rear panel at an angle of about 5° to 40° to form the wedge-shaped channel.

4. The appliance of claim 1 wherein the frame is constructed from an elastomeric material.

5. The appliance of claim 4 further comprising a transversely pliant, longitudinally arcuate flap positioned laterally along substantially the entire lateral length of the forward edge of the frame at the minor end of the channel and extending outward from the minor end.

6. The appliance of claim 5 wherein the flap is transversely flexible from a rest position, with the flap transversely spaced from the rear panel by a distance which is greater than the depth of the channel at the minor end, to an interactive position, with the flap transversely spaced from the rear panel by a distance which is less than the depth of the channel at the minor end; whereby the flap is effective for compressing a tube operably retained with the appliance between the flap and the rear panel only when pressed towards the rear panel and into the interactive position.

7. The appliance of claim 1 further comprising a means for mounting the frame to a support surface.

8. An appliance for accumulating and dispensing toothpaste from a standard toothpaste tube comprising a unitary fully stationary frame which defines a wedge-shaped channel having a maximum depth of about 3 to 7 cm at the major longitudinal end, and a minimum depth of about 0.5 to 1 cm at the minor longitudinal end, wherein the frame includes a front portion and a rear portion, with the front portion transversely spaced and longitudinally angled from the rear portion to form the wedge-shaped channel, and the frame is adapted for receiving a toothpaste tube placed into the channel through the major longitudinal open end and moved through the minor longitudinal open end.

9. The appliance of claim 8 wherein the channel is about 7 to 10 cm long and about 7 to 10 cm wide.

10. The appliance of claim 8 wherein the frame includes front and rear panels with the front panel transversely spaced and longitudinally angled from the rear panel at an angle of about 10° to 30° to form the wedge-shaped channel.

11. The appliance of claim 8 wherein the frame is constructed from an elastomeric material.

12. The appliance of claim 11 further comprising a transversely pliant, longitudinally arcuate flap positioned laterally along substantially the entire lateral length of the forward edge of the frame at the minor end of the channel and extending outward from the minor end.

13. The appliance of claim 12 wherein the flap is transversely flexible from a rest position, with the flap transversely spaced from the rear panel by a distance which is greater than the depth of the channel at the minor end, to an interactive position, with the flap transversely spaced from the rear panel by a distance which is less than the depth of the channel at the minor end; whereby the flap is effective for compressing a tube operably retained with the appliance between the flap and the rear panel only when pressed towards the rear panel and into the interactive position.

14. The appliance of claim 8 further comprising a means for mounting the frame to a support surface.

* * * * *